US010895841B2

(12) United States Patent
Murasaki et al.

(10) Patent No.: US 10,895,841 B2
(45) Date of Patent: Jan. 19, 2021

(54) IMAGE FORMING APPARATUS HAVING LINK MECHANISM FOR POSITIONING CARTRIDGE

(71) Applicant: CANON KABUSHIKI KAISHA, Tokyo (JP)

(72) Inventors: Satoshi Murasaki, Numazu (JP); Motoyasu Muramatsu, Susono (JP); Takashi Yano, Mishima (JP); Jiro Moriya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/691,485

(22) Filed: Nov. 21, 2019

(65) Prior Publication Data

US 2020/0174419 A1 Jun. 4, 2020

(30) Foreign Application Priority Data

Nov. 29, 2018 (JP) ..... 2018-224157

(51) Int. Cl.
*G03G 21/00* (2006.01)
*G03G 21/18* (2006.01)
*G03G 21/16* (2006.01)

(52) U.S. Cl.
CPC ..... *G03G 21/1842* (2013.01); *G03G 21/1633* (2013.01); *G03G 21/185* (2013.01); *G03G 2221/1684* (2013.01)

(58) Field of Classification Search
CPC ..... G03G 21/1633; G03G 21/1842; G03G 21/185; G03G 2221/1884; G03G 2221/1684
USPC ..... 399/111
See application file for complete search history.

(56) References Cited

U.S. PATENT DOCUMENTS

2009/0028601 A1* 1/2009 Mizuno ..... G03G 21/185 399/111
2009/0290904 A1* 11/2009 Kawai ..... G03G 21/185 399/111
2012/0207510 A1* 8/2012 Sato ..... G03G 15/1605 399/110

(Continued)

FOREIGN PATENT DOCUMENTS

JP 2009282396 A 12/2009
JP 2010164993 A 7/2010

(Continued)

*Primary Examiner* — Robert B Beatty
(74) *Attorney, Agent, or Firm* — Canon U.S.A., Inc., I.P. Division

(57) ABSTRACT

In an image forming apparatus, a link mechanism for mounting a cartridge on an apparatus main body, includes a pivot link and an intermediate link that moves from a first position for mounting the cartridge to a second position for image forming. A connecting portion to connect the intermediate link and the pivot link includes a boss with a protruded portion and a hole portion. When the intermediate link is at the second position, the protruded portion presses an inner surface of the hole portion such that a rotation moment in a direction in which the pivot link pivots, acts on the pivot link, and in a state where a portion-to-be-pressed of the cartridge is pressed by a pressing portion of the apparatus main body, a portion-to-be-positioned of the cartridge comes in contact with a positioning portion of the apparatus main body.

8 Claims, 10 Drawing Sheets

(56) References Cited

U.S. PATENT DOCUMENTS

| | | | | |
|---|---|---|---|---|
| 2014/0072332 | A1* | 3/2014 | Kitamura | G03G 21/1676 399/107 |
| 2015/0168911 | A1* | 6/2015 | Kuruma | G03G 21/1623 399/110 |
| 2017/0031275 | A1* | 2/2017 | Ohkubo | G03G 21/185 |
| 2017/0031312 | A1* | 2/2017 | Seto | G03G 21/185 |
| 2020/0117114 | A1* | 4/2020 | Otsubo | G03G 15/04036 |

FOREIGN PATENT DOCUMENTS

| | | | |
|---|---|---|---|
| JP | 4883818 | B2 | 2/2012 |
| JP | 2012150522 | A | 8/2012 |

* cited by examiner

IMAGE FORMING APPARATUS HAVING LINK MECHANISM FOR POSITIONING CARTRIDGE

BACKGROUND OF THE DISCLOSURE

Field of the Disclosure

The present disclosure relates to image forming apparatuses, such as copying machines, printers, and facsimiles, which employ an electrophotographic system, an electrostatic recording system, or the like.

Description of the Related Art

As an image forming apparatus of the electrophotographic system, widely used has been one in which a cartridge including a photosensitive drum and a process unit that acts on the photosensitive drum, is configured to be detachable relative to an apparatus main body of an image forming apparatus.

As a configuration for mounting and detaching a cartridge relative to an apparatus main body, Japanese Patent No. 4883818 discloses a guide rail configured to be able to move between a first position for mounting and detaching a cartridge and a second position where image forming is possible by using the cartridge.

By the way, when this guide rail is at the second position, it is necessary that the position of the cartridge in the mounting direction relative to the apparatus main body has been determined. Then, Japanese Patent No. 4883818 discloses a toggle mechanism that includes a lever and a spring to urge the lever and draws in a cartridge in the mounting direction. The lever rotates by coming in contact with the cartridge in the middle of mounting and engages with the cartridge. The spring urges the lever such that, when the rotation phase of the lever exceeds a predetermined phase, the lever rotates in the direction for drawing in the cartridge in the mounting direction. When the guide rail is at the second position, the cartridge is pressed by the lever such that the end, in the longitudinal direction, of the cartridge comes in contact with a side plate on the back side in the mounting direction, whereby the position of the cartridge in the mounting direction relative to the apparatus main body is determined.

However, in the toggle mechanism in Japanese Patent No. 4883818, it is necessary to move the cartridge in the mounting direction against a reaction force received by the cartridge from the lever during a period until the rotation phase of the lever exceeds a predetermined phase.

SUMMARY OF THE DISCLOSURE

An aspect of the present disclosure is to provide an image forming apparatus that reduces a necessary force when mounting a cartridge relative to an apparatus main body and has improved usability with regard to mounting of a cartridge.

According to one aspect of the present disclosure, an image forming apparatus is provided which includes a cartridge that having a rotating body configured to rotate about a rotational axis and to bear toner. The cartridge includes a portion-to-be-pressed and a portion-to-be-positioned; and an apparatus main body to which the cartridge is mountable in a direction of the rotational axis as a mounting direction. The apparatus main body includes a positioning portion and a link mechanism, the positioning portion being configured to determine a position of the cartridge in the direction of the rotational axis by coming in contact with the portion-to-be-positioned. The link mechanism includes a fixed link, a pivot link connected to the fixed link so as to be pivotable around a pivot axis, and an intermediate link connected to the pivot link at a connecting portion so as to be rotatable relative to the pivot link and extending in the mounting direction. The intermediate link includes a supporting portion to support the cartridge and a pressing portion configured to press the cartridge in the mounting direction by coming in contact with the portion-to-be-pressed of the cartridge supported by the supporting portion. The link mechanism is configured such that, with interlocking with a pivotal movement of the pivot link in a predetermined direction, the intermediate link moves from a first position to a second positon, the first position being a position in which the cartridge is mounted to and detached from the apparatus main body, the second position being a position for image forming and located on a downstream side of the first position in the mounting direction. The connecting portion includes a boss that extends along the pivot axis and a hole portion in which the boss is inserted, and the boss includes a cylinder portion and a protruded portion that protrudes to an outside of an imaginary circle of a cylindrical surface of the cylinder portion when viewing in a direction of the pivot axis. When the intermediate link is at the second position, the protruded portion presses an inner surface of the hole portion such that a rotation moment in a direction in which the pivot link pivots in the predetermined direction, acts on the pivot link, and in a state where the portion-to-be-pressed of the cartridge is pressed by the pressing portion of the apparatus main body, the portion-to-be-positioned of the cartridge comes in contact with the positioning portion of the apparatus main body.

Further features and aspects of the present disclosure will become apparent from the following description of example embodiments (with reference to the attached drawings).

DESCRIPTION OF THE EMBODIMENTS

Hereinafter, with reference to the drawings, a mode for carrying out the present disclosure is exemplarily described in detail on the basis of several examples.

EXAMPLE 1

Figure 1:
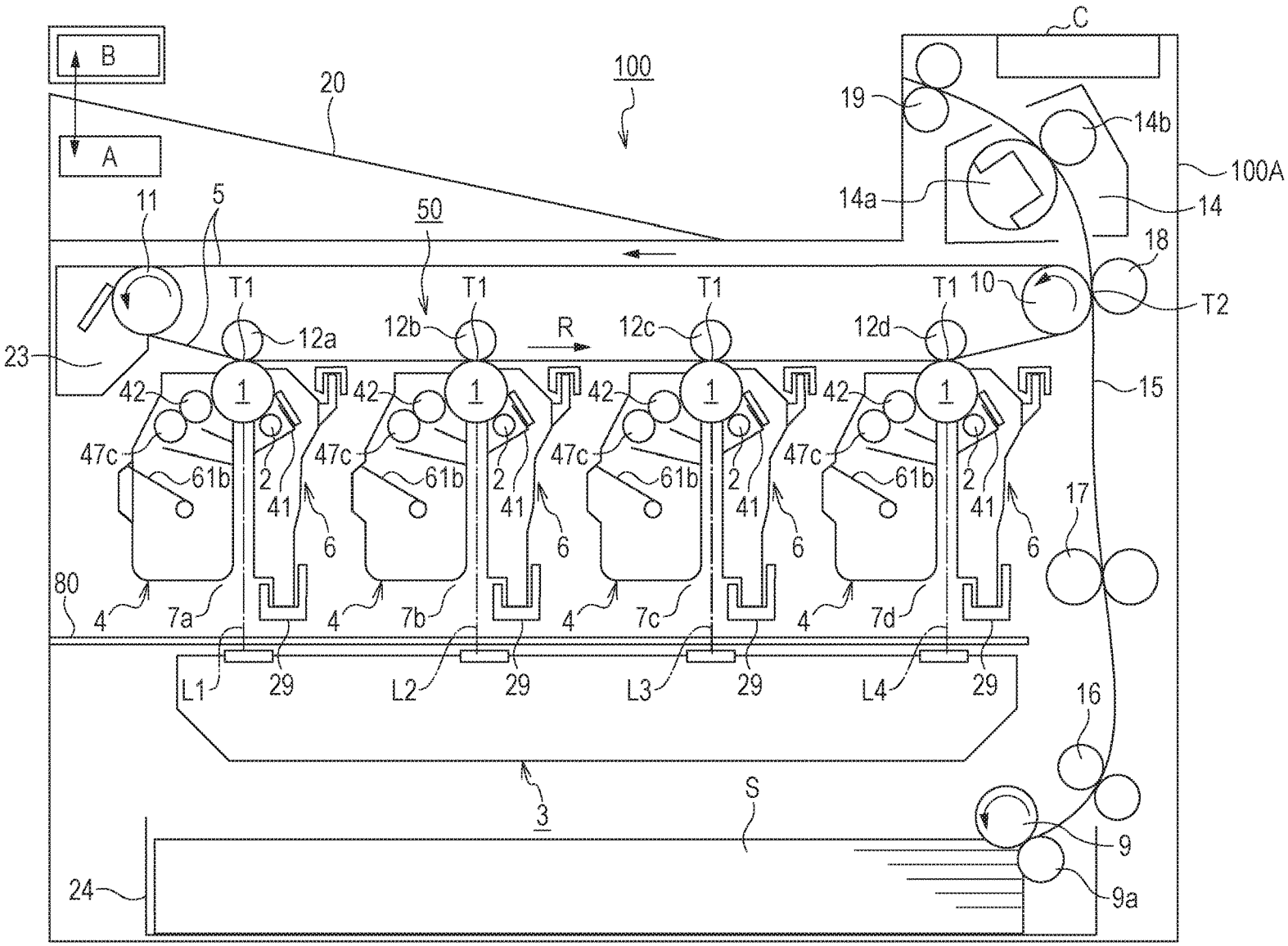
FIG. 1 is a schematic sectional view of an image forming apparatus according to an Example 1.
Figure 2A:
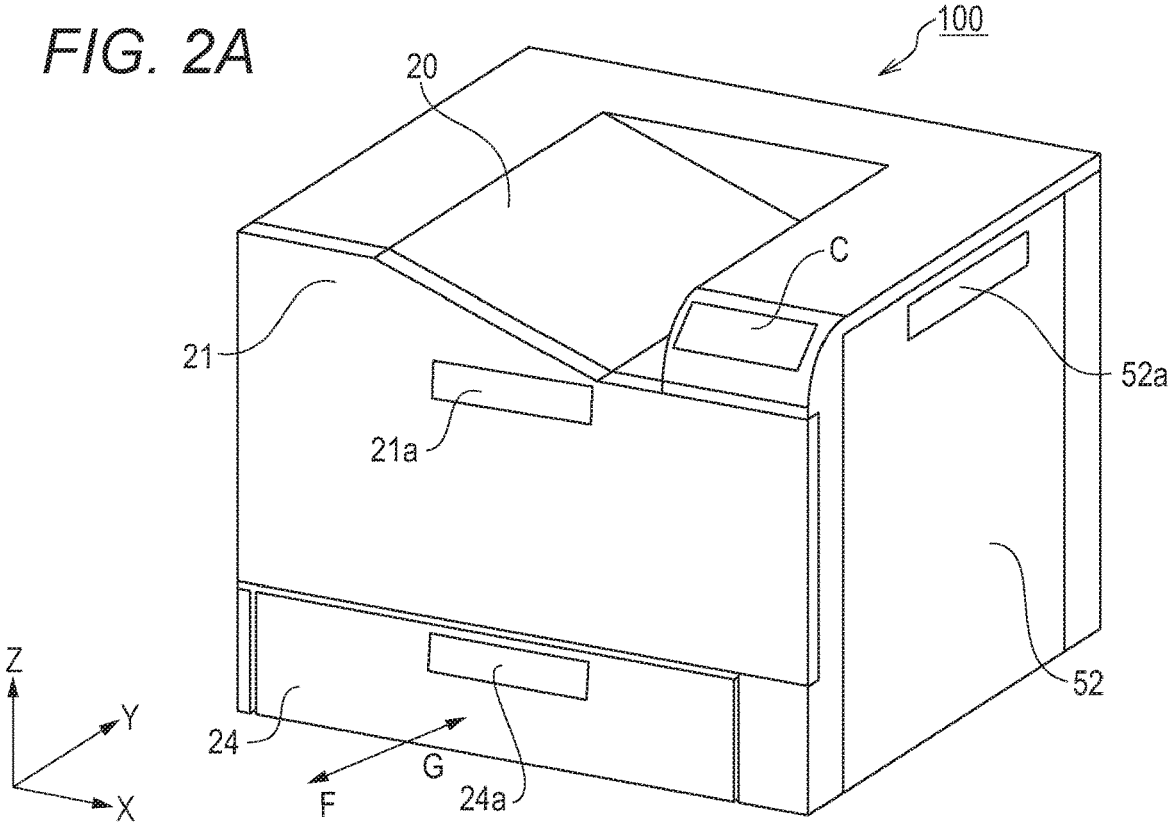
FIGS. 2A and 2B are perspective views of the image forming apparatus according to the Example 1.
Figure 2B:
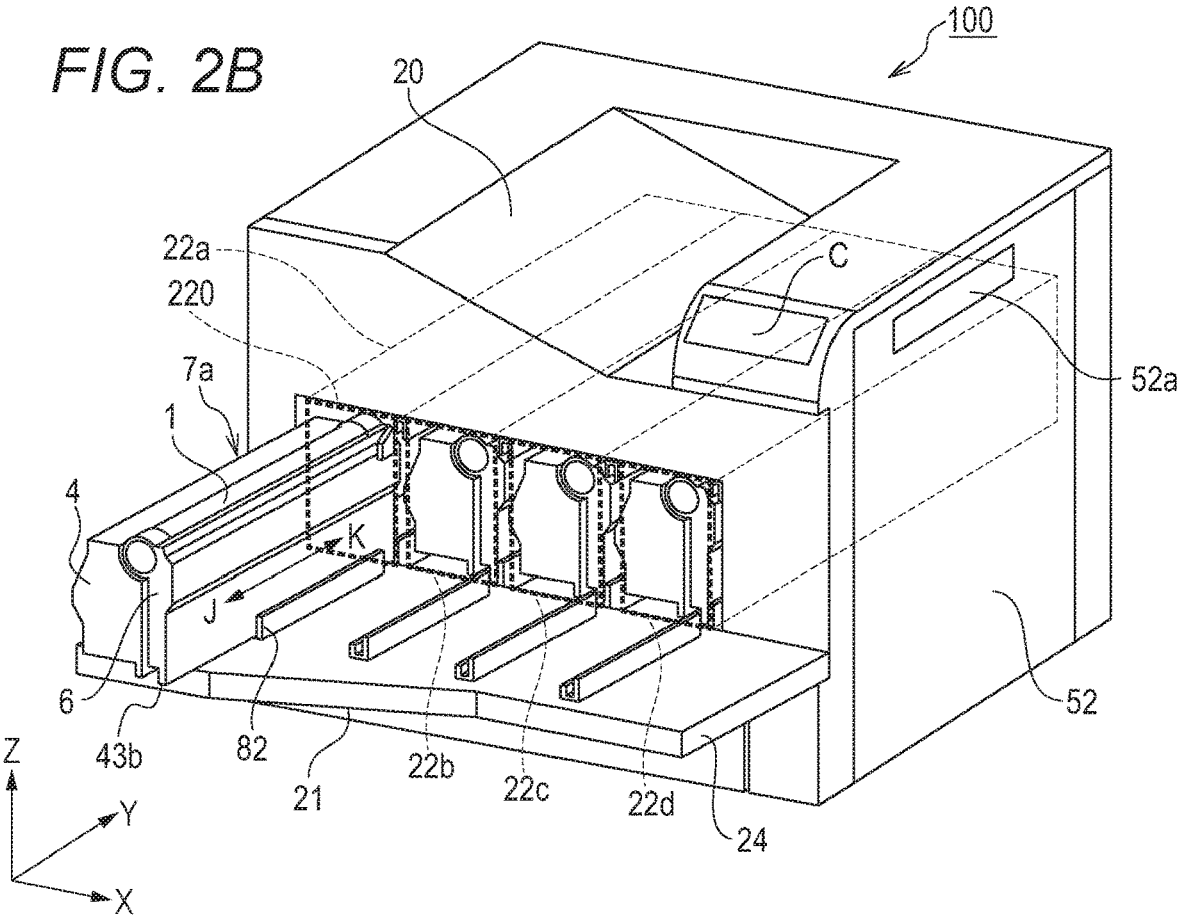

FIG. 1 is a schematic longitudinal sectional view of an image forming apparatus 100 in the present example. FIG. 1 shows a section of an image forming apparatus in a state capable of performing an image forming operation. FIGS. 2A and 2B are perspective views showing an appearance of the image forming apparatus 100. At this time, FIG. 2A is a perspective view showing an appearance of the image forming apparatus 100 in a state where a front door 21 is closed and image forming is possible. FIG. 2B shows a state where the front door 21 is opened and a first process cartridge 7*a* (hereinafter, abbreviated as a cartridge, for a sake of brevity) is pulled out relative to an apparatus main body 100A. Here, the front door 21 is defined as the front of the image forming apparatus 100.

The image forming apparatus 100 in the present example is a full color laser beam printer that performs image forming to a recording medium S using an electrophotographic process. The image forming relative to the recording medium S is performed on the basis of an image signal input into a control circuit part A from an external host device B, such as a personal computer image reader. The control circuit part A gives and receives various kinds of information with the external host device B and an operating portion C and controls comprehensively the image forming operation of the image forming apparatus 100 in accordance with a predetermined control program and a reference table.

The image forming apparatus 100 includes a first cartridge 7*a*, a second cartridge 7*b*, a third cartridge 7*c*, and a fourth cartridge 7*d*. Hereinafter, these cartridges (7*a* to 7*d*) are collectively referred to as cartridges 7. The apparatus main body 100A includes cartridge installation portions (22*a* to 22*d*) configured to be able to detachable each of the cartridges 7 independently. The apparatus main body 100A includes an opening portion 220 through which the cartridge 7 passes when the cartridge 7 is mounted on the cartridge installation portions 22. The apparatus main body 100A further includes the front door 21 as an opening and closing member configured to be able to move between a close position (FIG. 2A) where the opening portion 220 is closed and an open position (FIG. 2B) where the opening portion 220 is opened.

A mounting and detaching direction of the cartridge 7 relative to the apparatus main body 100A is a rotational axis direction of a drum 1 or a development roller 42 mentioned later. Each of the cartridges 7 includes a photosensitive member unit 6 and a developing unit 4. The photosensitive member unit 6 includes a drum 1 and a charging roller 2 as a processing unit that acts on the drum 1. The developing unit 4 includes the development roller 42, a toner supplying roller 48, and a toner storage chamber 47*a*.

In the toner storage chamber 47*a* of the developing unit 4 of each of the cartridges 7, a corresponding one of color toners of yellow (Y), magenta (M), cyan (C), and black (K) is stored. To the cartridge 7 mounted at a position where image forming is possible, a rotational driving force is transmitted from the apparatus main body 100A side, and the drum 1 is driven and rotated clockwise at a predetermined speed. Moreover, to the cartridge 7, a charging bias and a developing bias are supplied from the apparatus main body 100A side.

In the apparatus main body 100A, on a lower side, in the vertical direction, of the cartridge installation portions 22, there is provided a laser scanner unit 3 as an exposing unit relative to the drum 1 of the cartridge 7.

Moreover, in the apparatus main body 100A, on an upper side, in the vertical direction, of the cartridge installation portions 22, there is provided an intermediate transfer belt unit 500. This intermediate transfer belt unit 500 includes a driving roller 10 disposed on the right side relative to the front, a tension roller 11 disposed on the left side, and a cylindrical belt 5 suspended between both these rollers. With regard to the drum 1 of the cartridge 7 mounted at a position where image forming is possible, its upper surface portion in the vertical direction comes in contact with the bottom surface of the belt 5. The contact portion between this drum 1 and the belt 5 is a primary transfer part T1. Moreover, on the inside of the belt 5, there are provided four primary transfer rollers 12 (12*a* to 12*d*) that face relative to the respective drums 1 of the cartridges 7 across the belt 5. The belt 5 moves in the counterclockwise rotation of an arrow R at a speed corresponding to the rotation speed of the drum 1 by the driving roller 10 in a state of being in contact with the drum 1 of the cartridge 7. To each of the primary transfer rollers 12, a predetermined primary transfer bias is applied at a predetermined control timing. On the outside of a belt bending portion of the driving roller 10, there is provided a secondary transfer roller 18. A contact portion between the belt 5 and the secondary transfer roller 18 is a secondary transfer part T2. To the secondary transfer roller 18, a predetermined secondary transfer bias is applied at a predetermined control timing. On the outside of a belt bending portion of the tension roller 11, there is provided a transfer belt cleaning device 23.

On a lower side, in the vertical direction, of the apparatus main body 100A, there is provided a feeding device 13 of the recording medium S. The feeding device 13 includes a feeding cassette 24 that stores the recording medium S, a roller pair including a feeding roller 9 and a retard roller 9*a*, and a conveyance roller pair 16. Moreover, on the right side of the front of the apparatus main body 100A, there are provided a plurality of conveyance units so as to line in the vertical direction of the apparatus main body 100A from the feeding device 13. The plurality of conveyance units includes a registration roller pair 17, a conveyance path 15, the secondary transfer part T2, a fixing unit 14, and a discharge roller pair 19. On an upper surface, in the vertical direction, of the apparatus main body 100A, there is provided a discharge tray 20.

The feeding cassette 24 is configured to be able to be pulled out in an F-G direction and is provided to be accessible from the front relative to the apparatus main body 100A.

On the right-side face of the front of the apparatus main body 100A, there is provided a right door 52. By pulling a handle portion 52*a* of the right door 52 so as to make the right door 52 pivot, it is possible to open the conveyance path of the recording medium S. With this, in the case where the recording medium S jams, it is possible to secure a working space to perform a removal process for the jammed recording medium S.

The operations for forming a full color image are as follows. On the basis of a printing start signal, the control circuit part A starts an image forming operation for the image forming apparatus 100. That is, in association with an image forming timing, the drum 1, the belt 5, and the laser scanner unit 3 are driven. The drum 1 is driven and rotated at a predetermined speed in the clockwise direction of an arrow. The belt 5 is driven and rotated at a speed corresponding to the speed of the drum 1 in the counterclockwise direction (forward direction to the rotation of the drum) of the arrow R. In synchronization with these drives, in the cartridge 7, by the charging roller 2 to which a predetermined charging bias is applied, the surface of the drum 1 is uniformly charged to a predetermined potential with a predetermined polarity. The laser scanner unit 3 scans and exposes the surface of the drum 1 with laser beams L (L1 to L4) modulated correspondingly to an image information signal of each of colors of Y, M, C, and K. The laser beams L are emitted upward from first to fourth window portions 81 (81*a* to 81*d*), respectively, provided on an upper surface plate 80 of the laser scanner unit 3. The laser beams L (L1, L2, L3, and L4) output from the laser scanner unit 3, enters a corresponding one of the cartridges 7 from a laser beam incident opening portion 63 on a lower side, and irradiates the bottom surface of the drum 1. With this, on the surface of each of the drums 1, an electrostatic latent image corresponding to an image information signal of a corresponding color is formed. The formed electrostatic latent image is developed as a toner image by the development roller 42 of the developing unit 4.

By the above-described image forming process operation, a Y color toner image is formed on the drum 1 of the first cartridge 7*a*, and the toner image is primarily transferred onto the belt 5 at the primary transfer part T1 of the first cartridge 7*a*. A M color toner image is formed on the drum 1 of the second cartridge 7*b*, and the toner image is primarily transferred so as to be superimposed on the Y color toner image on the belt 5 at the primary transfer part T1 of the cartridge 7*b*. A C color toner image is formed on the drum 1 of the third cartridge 7*c*, and the toner image is primarily transferred so as to be superimposed on the Y color+M color toner images on the belt 5 at the primary transfer part T1 of the cartridge 7*c*. On the drum 1 of the fourth cartridge 7*d*, a K color toner image corresponding to the black component of a full colon image is formed, and the toner image is primarily transferred so as to be superimposed on the Y color+M color+C color toner images on the belt 5 at the primary transfer part T1 of the cartridge 7*d*. To each of the first to fourth primary transfer rollers 12 (12*a* to 12*d*), a primary transfer bias with a predetermined potential and a reverse polarity relative to the charge polarity of toner is applied at a predetermined control timing.

In this way, on the belt 5, unfixed toner images of full color of four colors are formed. These unfixed toner images are conveyed by the rotation of the belt 5 and arrive at the secondary transfer part T2.

In the cartridge 7, from the surface of the drum 1 after the primary transfer of the toner image relative to the belt 5, primary-transfer remaining toner is removed by a cleaning member 41 of a cleaning unit 6, and the drum 1 is cleaned and is provided to the following image formation process.

On the other hand, the recording medium S in the feeding cassette 24 is fed out by the feeding roller 9 and the retard roller 9*a* by one sheet at a predetermined control timing and is conveyed by the conveyance roller pair 16 toward the registration roller pair 17. The recording medium S is conveyed by the registration roller pair 17 through the conveyance path 15 to the secondary transfer part T2 at a predetermined control timing. To the secondary transfer roller 18, a secondary transfer bias with a predetermined potential and a reverse polarity relative to the charge polarity of toner is applied at a predetermined control timing. With this, in a process in which the recording medium S is pinched and conveyed in the secondary transfer part T2, the our-color-superimposed toner images on the belt 5 are secondarily transferred sequentially in a lump onto the recording medium S. The recording medium S having exited from the secondary transfer part T2 is separated from the belt 5 and is conveyed to the fixing unit 14. Then, while being nipped and conveyed by a fixing nip portion that is a pressure-contact nip portion with a fixing member 14*a* and a pressing member 14*b* in the fixing unit 14, the toner image is subjected to heating and pressurizing and is fixed onto the recording medium S. The recording medium S having exited from the fixing unit 14 is discharged to the discharge tray 20 by a discharge roller 19.

The secondary transfer residual toner having remained on the surface of the belt 5 after the secondary transferring of the toner image to the recording medium S is removed from the surface of the belt by the transfer belt cleaning device 23, and the cleaned belt surface is provided to the following image forming process.

The toner removed by the transfer belt cleaning device 23 passes a waste toner conveyance path (not-illustrated), is conveyed to a waste toner collecting container (not-illustrated) disposed at a back-side portion of the apparatus and is collected.

[Example Configuration of Cartridge]

Figure 3:
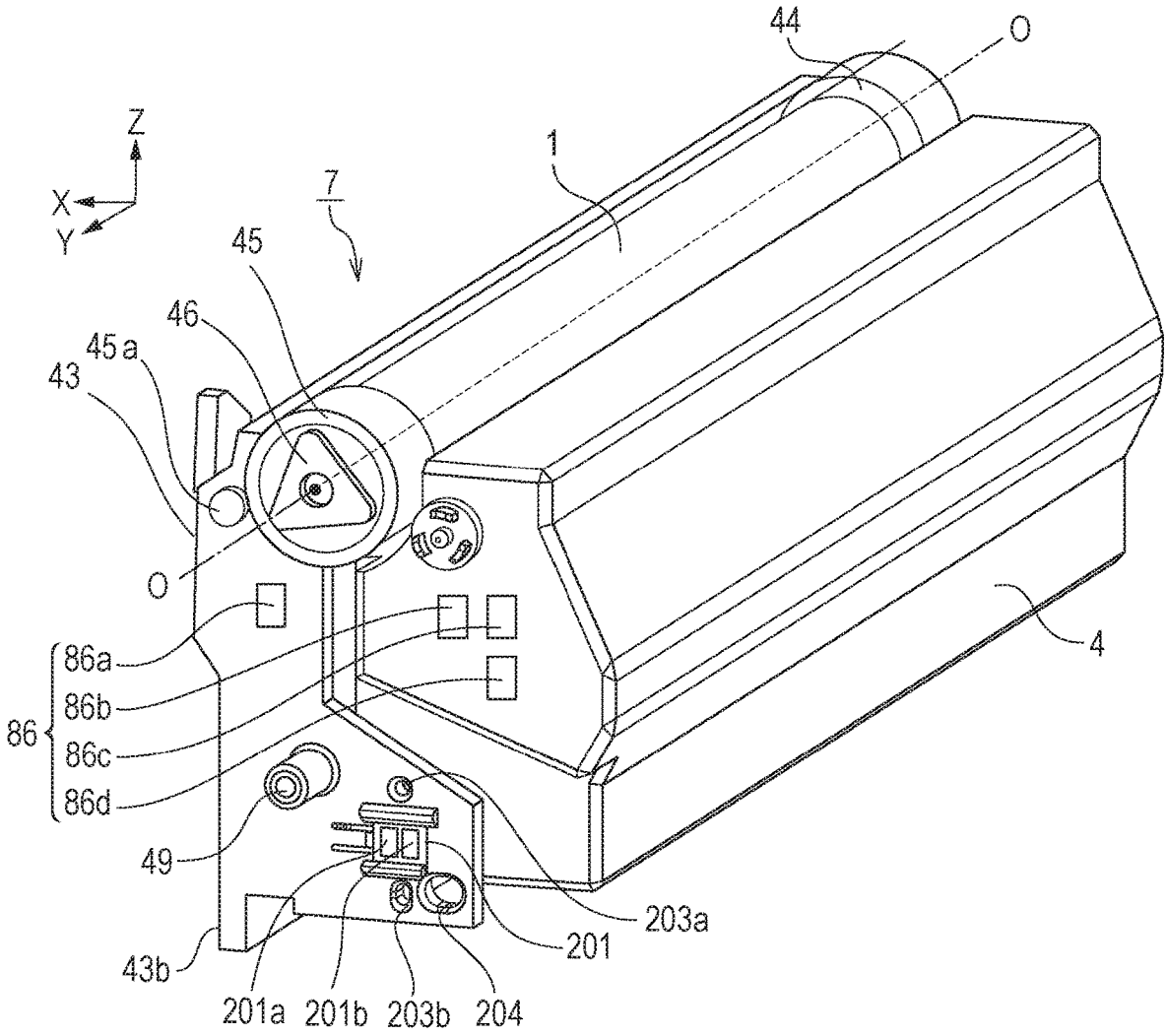
FIG. 3 is a perspective view of a cartridge according to the Example 1.
Figure 4:
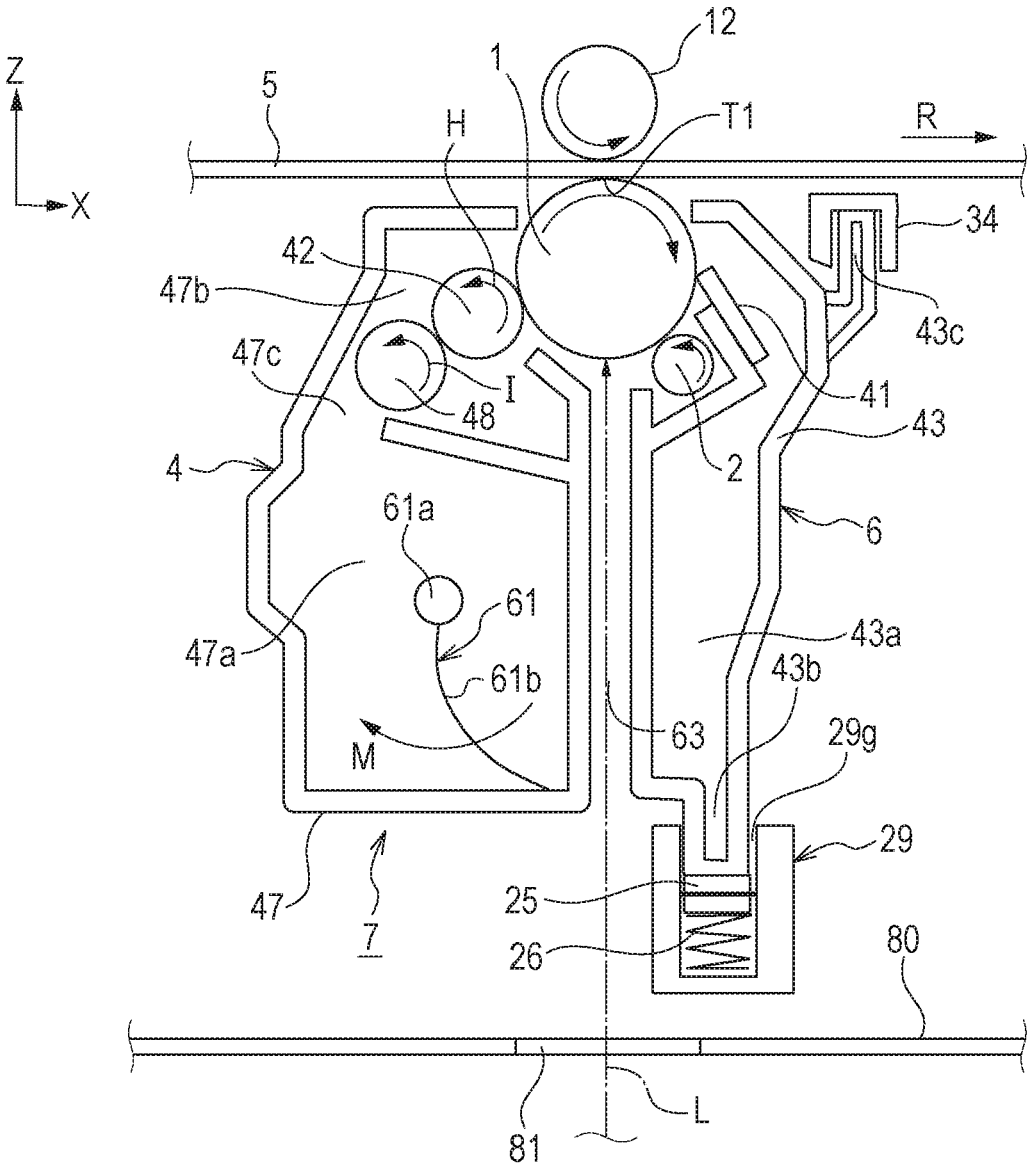
FIG. 4 is a sectional view of the cartridge in a state of being mounted on the apparatus main body and its peripheral portion according to the Example 1.

The cartridge 7 in the present example will be described using FIGS. 3 and 4. Each of the cartridges 7 only differs in the color of the toner stored in the toner storage chamber of the developing unit 4 and has the same configuration. FIG. 3 is an external perspective view when viewing the cartridge 7 from the back side (drive side) in the mounting direction. FIG. 4 is a sectional view of the cartridge 7 mounted at a position where image forming is possible, in the apparatus main body 100A and its peripheral portion.

The cartridge 7 is an assembly which makes a rotational axis direction O-O of the drum 1 shown in FIG. 3, a longitudinal direction and includes the photosensitive member unit 6 and the developing unit 4. The photosensitive member unit 6 includes the drum 1, the charging roller 2, and the cleaning member 41, and the developing unit 4 includes a developing unit 4 including the development roller 42 as a developing member.

To a cleaning frame 43 of the photosensitive member unit 6, the drum 1 is attached rotatably via bearing members 44 and 45 on the front side and the back side. On the circumference of the drum 1, the charging roller 2 and the cleaning member 41 are disposed. The charging roller 2 comes in contact with the drum 1 with a predetermined pressure and rotates with following the rotation of the drum 1. The cleaning member 41 comes in contact with the drum 1 with a predetermined pressure. The cleaning member 41 removes the toner from the surface of the drum 1, which has remained without having been transferred to the belt 5 at the primary transfer part T1, and the removed toner is stored in a removed toner chamber 43*a*. On an end portion on a back side of the cleaning frame 43 when viewing from the mounting direction, there is provided a drive input coupling (drive receiving part) 46.

On a development frame 47 of the developing unit 4, there are provided the toner storage chamber 47*a* that stores toner and a developing chamber 47*b* in which disposed is the development roller 42 that comes in contact with the drum 1 and rotates in the direction of an arrow H. The developing chamber 47*b* is disposed above relative to the toner storage chamber 47*a*, and the toner storage chamber 47*a* and the developing chamber 47*b* communicate with each other through an opening portion 47*c* located above the toner storage chamber 47*a*. On the circumference of the development roller 42, there is disposed the toner supplying roller 48 as a toner supplying member that comes in contact with the development roller 42 and rotates in the direction of an arrow I.

In the toner storage chamber 47*a*, there is provided a toner stirring member 61 that is rotatable in order to stir the stored toner and to send toner through the opening portion 47*c* relative to the toner supplying roller 48 in the developing chamber 47*b*. The toner stirring member 61 includes a shaft member 61*a* and a sheet 61*b* attached to the shaft member 61*a*. The sheet 61*b* is a sheet made of a flexible resin for performing stirring and conveying toner. The toner stirring member 61 is driven and rotated at a predetermined speed in the direction of an arrow M correspondingly to the image forming operation.

The development frame 47 of the developing unit 4 is combined integrally relative to the cleaning frame 43 of the photosensitive member unit 6.

At a lower portion of the cleaning frame 43, a guide rib 43*b* is formed along the longitudinal direction of the cleaning frame 43. This guide rib 43*b* engages with a guide groove portion 82 (FIG. 2B) of the front door 21. The guide rib 43*b* of the cartridge engages with the guide groove portion 82, whereby, when the cartridge 7 moves in the mounting direction, the cartridge 7 is guided. A clearance portion between the photosensitive member unit 6 and the developing unit 4 is a slit opening portion 63 through which a laser beam is incident (FIG. 4).

The cartridge 7 is mounted on the cartridge installation portions 22 of the apparatus main body 100A, and at a position where image forming is possible, the upper surface of the drum 1 comes in contact with the belt 5, whereby the primary transfer part T1 is formed. Moreover, relative to the drive input coupling 46, a drive output coupling (being not illustrated) on the apparatus main body 100A side is combined. By transmitting a driving force from the drive output coupling to the drive input coupling 46, the drum 1, the development roller 42, the toner supplying roller 48, and the toner stirring member 61 are driven and rotated correspondingly to the image forming operation. Moreover, as shown in FIG. 3, on a side face of the cartridge 7, input electric contacts 86 (86*a*, 86*b*, 86*c*, and 86*d*) are disposed, and, for these input electric contacts, output electric contacts (not-illustrated) on the apparatus main body 100A side are configured to be electrically arranged and connected. By applying a predetermined bias from the output electric contacts to the input electric contacts, a predetermined charging bias and developing bias of the charging roller 2 and the development roller 42 are applied correspondingly to the image forming operation. Moreover, slit opening portions 63 as a laser beam incident opening portion correspond to laser emission window portions 81 (81*a* to 81*d*) provided on the upper surface plate 80 of the laser scanner unit 3. The laser beams L (L1 to L4) output from the laser scanner unit 3, enters the cartridge 7 from the slit opening portion 63 on the lower side and irradiates the bottom surface of the drum 1.

Furthermore, on the bottom surface portion of the cartridge 7, a later-mentioned hooking portion with a concave shape is integrally provided. An engaged state with the apparatus main body will be described later.

[Exchanging Method of Process Cartridge]

As shown in FIG. 2B, in the image forming apparatus 100 in the present example, the exchange of the cartridge 7 is performed by opening the front door 21 being an opening and closing member that the apparatus main body 100A includes. A reference numeral 21*a* is a handle portion disposed on the front door 21. On the frame 37, on the front side, of the apparatus main body 100A, there is provided the opening portion 220. The opening portion 220 is a portion through which the cartridge 7 passes when the cartridge 7 is mounted on the cartridge installation portion 22 of the apparatus main body 100A and when the cartridge 7 is dismounted from the cartridge installation portions 22. The front door 21 is provided to be movable between a close position where the opening portion 220 is closed and an open position where the opening portion 220 is opened.

Figure 5A:
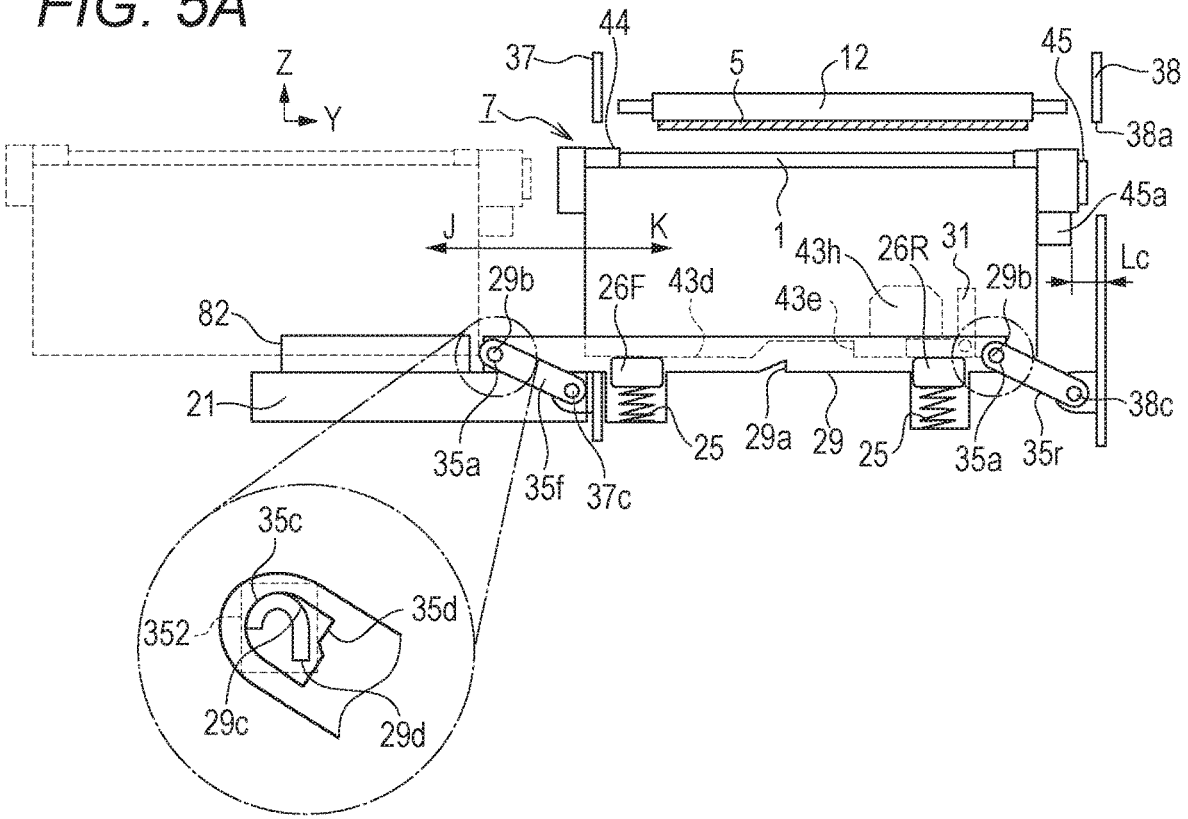
FIG. 5A is an illustration showing a position of each of the cartridge and the guide rail when the guide rail according to the Example 1 is at a first position.
Figure 5B:
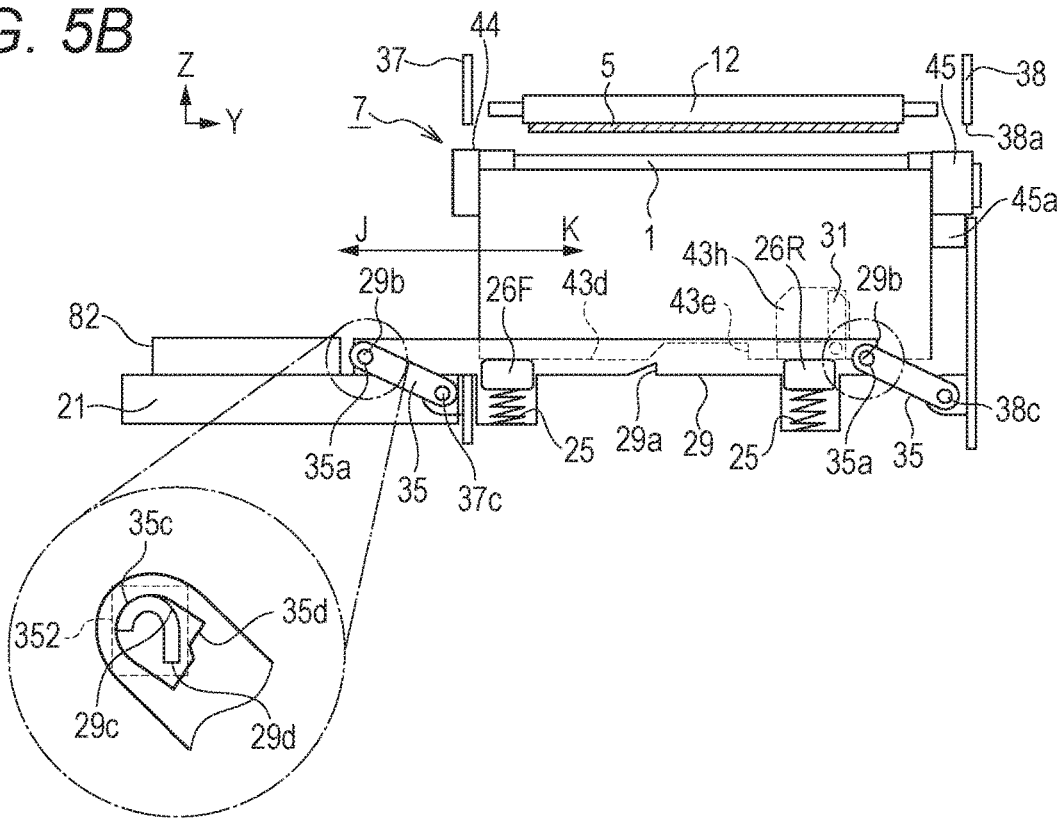
FIG. 5B is an illustration showing a position of each of the cartridge and the guide rail when the guide rail according to the Example 1 is at a third position.
Figure 6A:
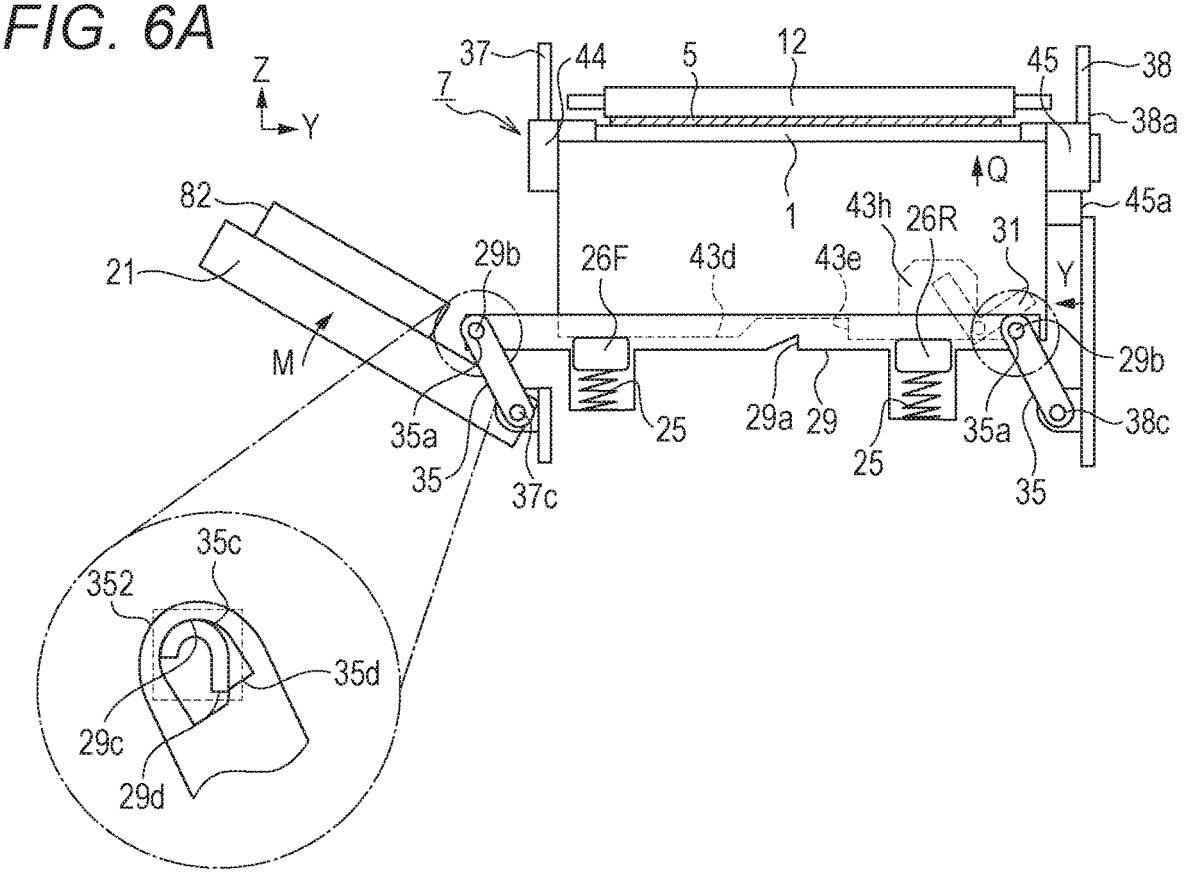
FIG. 6A is an illustration showing a position of each of the cartridge and the guide rail when the guide rail according to the Example 1 is between the third position and a second position.
Figure 6B:
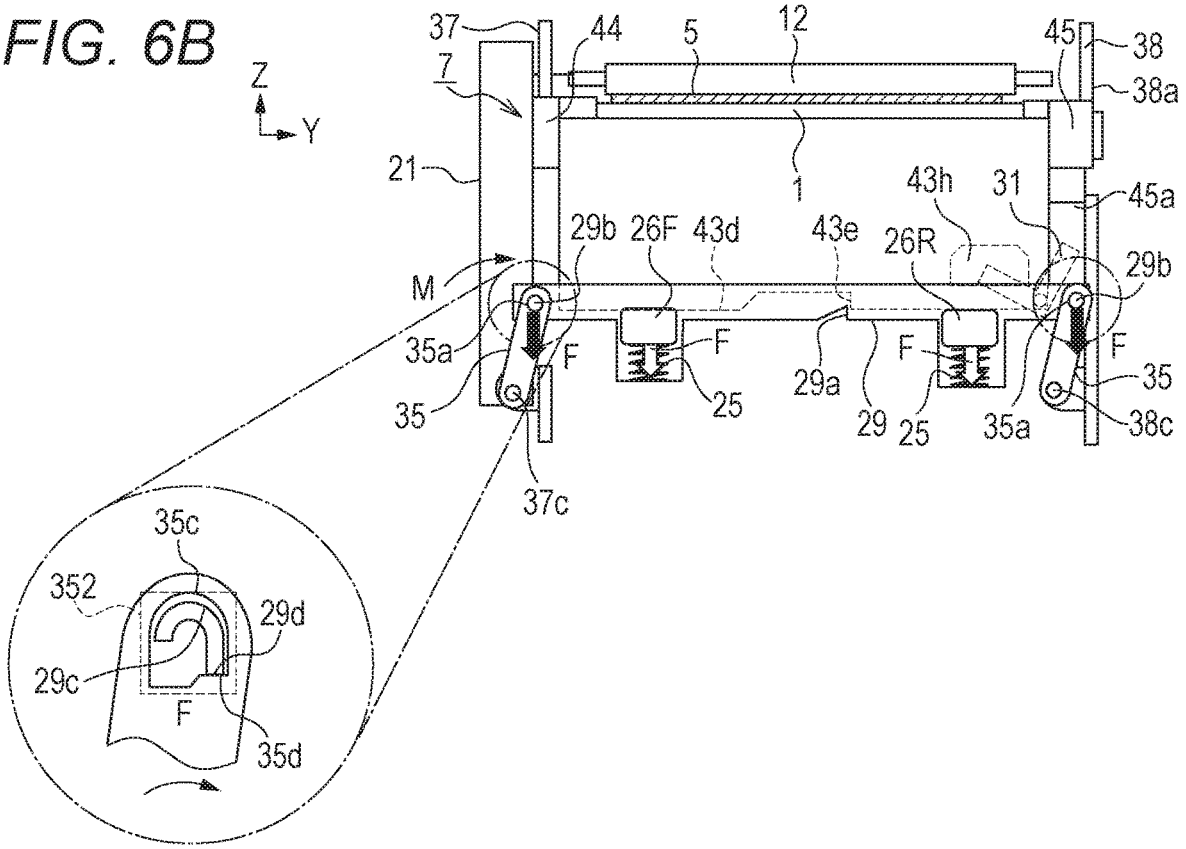
FIG. 6B is an illustration showing a position of each of the cartridge and the guide rail when the guide rail according to the Example 1 is at the second position.

FIGS. 5A, 5B, 6A, and 6B show illustrations for describing the operation of each element of the apparatus main body A in time series when the cartridge 7 is mounted on the apparatus main body 100A. FIG. 5A is an illustration showing a state in the middle of moving the cartridge 7 in the longitudinal direction (rotational axis direction of the drum 1) toward the back side of the cartridge installation portions 22. FIG. 5B is an illustration showing a state where, after the cartridge 7 has been caused to further move to the back side of the apparatus main body 100A from the state in FIG. 5A, the position of the cartridge 7 in the mounting direction relative to the apparatus main body 100A has been determined. FIG. 6A is an illustration showing a state where the cartridge 7 has been caused to move, from the state in FIG. 5B, in a direction in which the front door 21 closes and the movement of the cartridge 7 in the vertically upward direction has been completed, and a state where the position of the cartridge 7 in the vertical direction relative to the apparatus main body 100A has been determined. FIG. 6B is an illustration showing a state where the front door 21 has been closed completely and also the rise of a guide rail 29 has been completed. Moreover, FIGS. 7A to 7D are illustrations showing an operating status of a drawing-in lever 31 for each state of FIGS. 5A, 5B, 6A, and 6B.

As shown in FIG. 5A, the cartridge 7 is slid and moved on the guide rail 29 in the direction of an arrow K in the illustration (in the direction from the front side to the back side in the apparatus main body). This direction of the arrow K is made a mounting direction of the cartridge 7. As mentioned above, at a lower portion of the cleaning frame 43 of the cartridge 7, the guide rib 43*b* is provided along the longitudinal direction of the cleaning frame 43, and at an upper portion of the cleaning frame 43, a guide protrusion 43*c* is provided (FIG. 4). When the cartridge 7 is located on the front door 21 in the state of being opened, the guide rib 43*b* engages with the guide groove portion 82 (FIGS. 5A and 5B) provided to the front door 21. Moreover, when the cartridge 7 is located on the guide rail 29, the guide rib 43*b* engages with a guide groove portion 29*g* provided on the guide rail 29, and the guide protrusion 43*c* engages with a guide groove portion 34 provided above, in the vertical direction, the cartridge installation portions 22. With these engagements, the cartridge 7 is guided when moving in the mounting direction.

The state shown in FIG. 5A is an incomplete mounting state where the front door 21 is at an open position and the cartridge 7 has not reached at a position where positioning in the mounting direction is performed. At this time, a clearance Lc exists between a frame 38 and a butting portion 45*a* of the cartridge 7.

Here, a link mechanism 355 that the apparatus main body 100A includes is described. The link mechanism 355 includes frames 37 and 38 as a fixed link, a first pivot link 35*f* and a second pivot link 35*r* that are connected to the frames 37 and 38 respectively so as to be pivotable, and the guide rail 29 (intermediate link) extended in the mounting direction. The first pivot link 35*f* and the second pivot link 35*r* are connected to the guide rail 29 so as to be pivotable.

The first pivot link 35*f* is assembled to the frame 37 so as to be rotatable around a pivot center 37*c*. The second pivot link 35*r* is assembled to the frame 38 so as to be rotatable around a pivot center 38*c*. The first pivot link 35*f* is provided on the upstream side in the mounting direction of the second pivot link 35*r*. Each of the first pivot link 35*f* and the second pivot link 35*r* is provided on the both ends of the guide rail 29 in the axial direction of each of the pivot centers 37*c* and 38*c*. The guide rail 29 is configured to move from a first position to a second position with interlocking with the pivotal movement, in a predetermined direction (clockwise in FIGS. 5A and 5B), of the first pivot link 35*f* and the second pivot link 35*r*. The first position of the guide rail 29 is a position shown in FIG. 5A and is a position for mounting and detaching the cartridge 7 relative to the apparatus main body 100A. The second position of the guide rail 29 is a position that is shown in FIG. 6B and at which the cartridge 7 can form an image. Moreover, the guide rail 29 is configured to move from the second position (FIG. 6B) to the first position (FIG. 5A) with interlocking with the pivotal movement, in the reverse direction to the predetermined direction (counterclockwise in FIGS. 5A and 5B), of the first pivot link 35*f* and the second pivot link 35*r*. The first pivot link 35*f* and the second pivot link 35*r* are interlocked with the opening and closing operation of the front door 21.

Moreover, a third position (FIG. 5B) is a position between the first position and the second position and is a position where the positioning, in the mounting direction, of the cartridge 7 relative to the apparatus main body 100A has been completed and the positioning in the vertically upward direction has not been completed. The third position is located on an upper side in the vertical direction from the second position.

In the present example, the rotation center axis line of the first pivot link 35*f* and the rotation center axis line of the second pivot link 35*r* are parallel to each other, and the guide rail 29 performs parallel movement in the mounting direction (the direction of K) while raising the height. That is, the second position of the guide rail 29 is located on a downstream side in the mounting direction (the direction of K) and on an upper side in the vertical direction of the first position.

The guide rail 29 includes a toggle mechanism 312 for drawing in the cartridge 7 in the mounting direction. The toggle mechanism 312 includes a pivotable lever 31 and a tension spring 32 (urging member) that urges the lever 31 such that the lever 31 rotates in a direction in which the cartridge 7 is pressed in the mounting direction (the direction of K). As shown in FIGS. 5A to 7D, the lever 31 is held to be rotatable relative to the guide rail 29. The cartridge 7 on the guide rail 29 is urged in the mounting direction by the lever 31 having been urged with the tension spring 32, and the butting portion 45*a* (first portion-to-be-positioned) of the cartridge 7 is made to butt against a surface (first positioning portion) on the inside of the frame 38. At this time, the lever 31 is urged by engaging with an engaging hole 43*h* provided to the cartridge 7. With this, the position of the cartridge 7 in the mounting direction relative to the apparatus main body 100A is regulated, and the cartridge 7 is configured to move to the third position and the second position while being urged to the frame 38.

The guide rail 29 further includes, as shown in FIGS. 4 to 6B, pressurizing followers 26 (26F and 26R) as a supporting member to support the cartridge 7 and a compression spring 25 as an urging member on a surface facing the bottom surface of the cartridge 7. The pressurizing followers 26 are assembled to be movable in the vertical direction and are urged vertically upward by the compression spring 25. In the cartridge 7, a supported surface 43*d* corresponding to the bottom surface of the guide rib 43*b* is supported by a supporting surface corresponding to the upper surface of the pressurizing followers 26 (26F and 26R).

Moreover, the guide rail 29 includes a pressing portion 29*a* that protrudes in the vertically upward direction toward the cartridge 7 supported by the guide rail 29. When the front door 21 has been closed completely and the guide rail 29 is located at the second position, a portion-to-be-pressed 43*e* existing in the recess on the bottom surface of the cartridge 7 has become a state of having been in contact with the pressing portion 29*a* of the guide rail 29.

A connecting portion 352 where the first pivot link 35*f* and the guide rail 29 are connected rotatably with each other, includes a boss 29*b* extended in the direction of the pivot center axis line of the first pivot link 35*f* of the guide rail 29 and a hole portion 35*a* in which the boss 29*b* is inserted.

The boss 29*b* includes a cylinder portion 29*c* including a vertically upper half cylindrical surface and a rib 29*d* as a protruded portion extended in the vertically downward direction so as to protrude from an imaginary circle ye that passes a cylinder surface made the center of the cylinder portion 29*c* in the radial direction of the cylinder portion 29*c*. The hole portion 35*a* includes a peripheral surface portion 35*c* that faces the cylinder portion 29*b* and a flat surface portion 35*d* that faces the rib 29*d* of the guide rail 29 when the guide rail 29 is at the second position.

When the guide rail 29 moves from the first position (FIG. 5A) to the third position (FIG. 5B) with interlocking with the opening and closing operation of the front door 21, the cylinder surface of the cylinder portion 29*c* of the boss 29*b* and the peripheral surface portion 35*c* of the hole portion 35*a* slide on each other. Moreover, when the guide rail 29 is at the second position (FIG. 6B), the rib 29*d* of the boss 29*b* becomes a state of pressing the flat surface portion 35*d* of the hole portion 35*a* downward in the vertical direction.

Figure 7A:
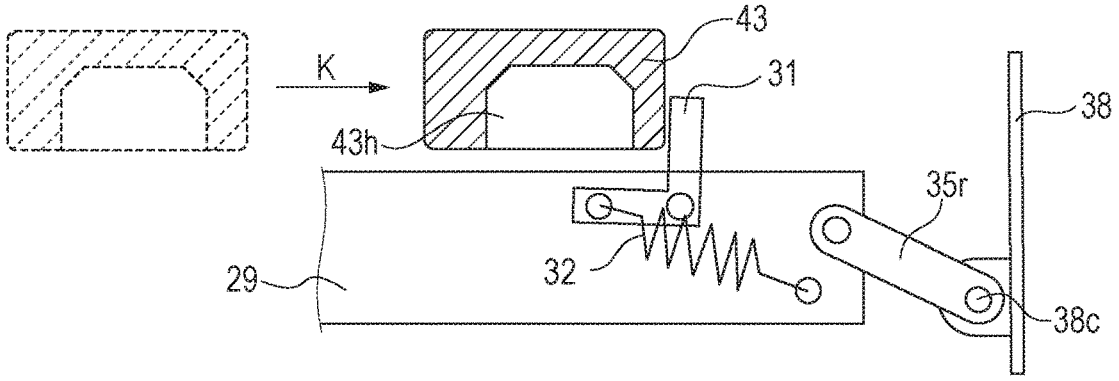
FIG. 7A is an illustration showing a toggle mechanism and the cartridge before a cleaning frame comes in contact with a lever when the cartridge according to the Example 1 is mounted onto the apparatus main body.
Figure 7B:
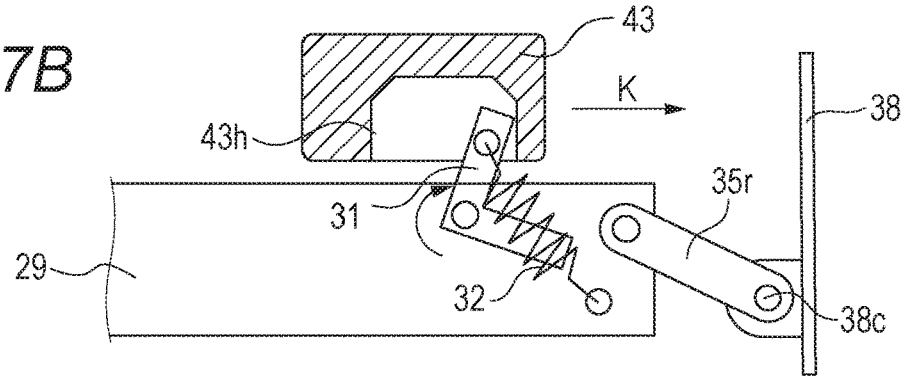
FIG. 7B is an illustration showing the toggle mechanism and the cartridge after the cleaning frame has come in contact with the lever when the cartridge according to the Example 1 is mounted onto the apparatus main body.

As shown in FIG. 7A, when a user moves the cartridge 7 in the mounting direction in the apparatus main body 100A, the lever 31 rotates clockwise in the illustration by being pushed by a tip portion 43 of the cartridge 7. As shown in FIG. 7B, when an engaged portion of the lever 31 with which one end of the tension spring 32 engages becomes a rotation phase in which the engaged portion is located on a downstream side in the mounting direction of the rotation center of the lever 31, the lever 31 rotates clockwise with the spring force of the tension spring 32. The cartridge 7 reaches, by the lever 31, at the third position where the butting portion 45*a* of the cartridge 7 is made to butt against the frame 38 (FIG. 5B). With this, the position of the cartridge 7 in the apparatus direction is determined. At this time, in a connecting portion 293 between the boss 29*b* of the guide rail 29 and the hole portion 35*a* of the first pivot link 35*f*, the cylinder portion 29*c* of the boss 29*b* and the peripheral surface portion 35*c* of the hole portion 35*a* come in contact with each other, and the rib 29*d* of the boss 29*b* and the flat surface portion 35*d* of the hole portion 35*a* do not come in contact with each other. With this, in the state where the front door 21 is opened, it becomes possible to lower the guide rail 29 to the first position for mounting and detaching the cartridge 7.

Figure 7C:
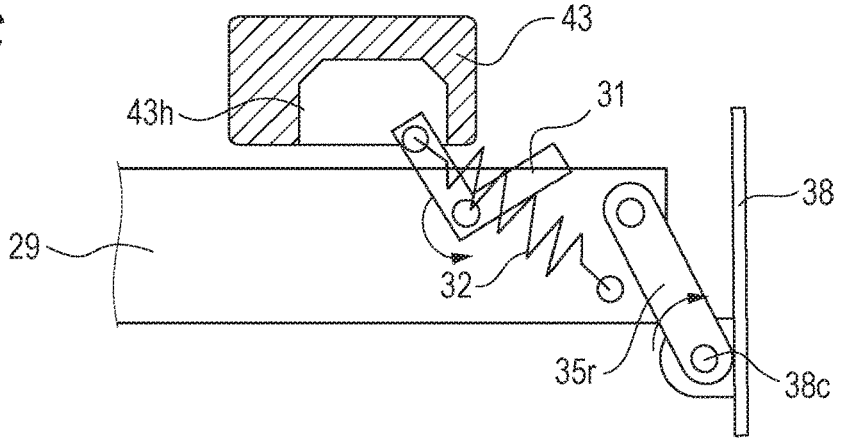
FIG. 7C is an illustration showing the toggle mechanism and the cartridge when the closing of a door according to the Example 1 has been started.
Figure 7D:
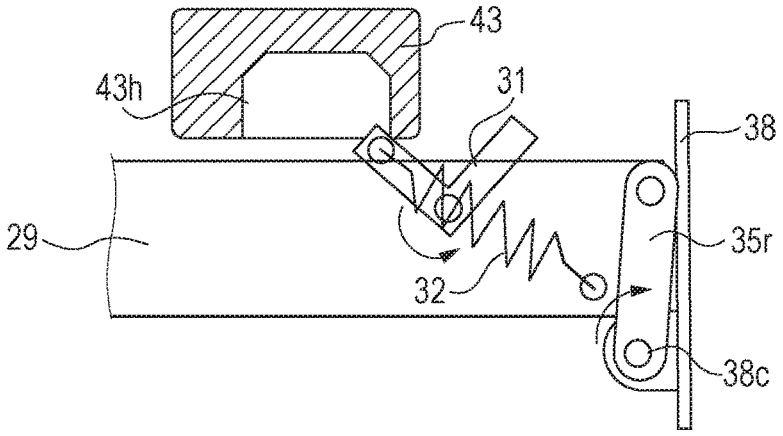
FIG. 7D is an illustration showing the toggle mechanism and the cartridge when the door according to the Example 1 has been completely closed.

Furthermore, as shown in FIGS. 6A and 7C, when starting the closing operation to make the front door 21 pivot in the direction of the arrow M, the guide rail 29 moves in the mounting direction and vertically upward, and the cartridge 7 moves in the vertical direction (the direction of an arrow Q in the illustration). Then, a bearing member 44 on the front side of the cartridge 7 and a bearing member 45 (the second portion-to-be-positioned) on the back side are made to butt against a butting portion 37*a* of the frame 37 and a butting portion 38*a* (the second positioning portion) of the frame 38, respectively. With this, the position of the cartridge 7 in the vertical direction relative to the apparatus main body 100A of is determined. When viewing in the rotational axis direction of the drum 1, each of the butting portion 37*a* and the butting portion 38*a* is a plate metal edge surface in an inverted V-shape. At this time, the guide rail 29 moves toward the apparatus main body (the direction of Y in the illustration), while, since the butting portion 45*a* has butted against the frame 38, the cartridge 7 cannot move in the direction of Y. Therefore, although an operation to make the lever 31 rotate in the counterclockwise direction is performed, since the tension spring 32 does not exceed the rotation center of the lever 31, the cartridge 7 is held at a position (the first position) where the butting portion 45*a* of the cartridge 7 has butted against the frame 38 on the back side. At this time, in the engaging portion between the guide rail 29 and the pivot link 35*a*, the cylinder portion 29*c* of the boss 29*b* and the peripheral surface portion 35*c* of the hole portion 35*a* come in contact with each other, and the rib 29*d* of the boss 29*b* and the flat surface portion 35*d* of the hole portion 35*a* do not come in contact with each other. With this, with interlocking with the closing operation of the front door 21, it becomes possible for the guide rail 29 to move (parallel movement) in the mounting direction while rising, in a state of having maintained a state parallel to the horizontal direction.

Finally, while the front door 21 is made to be moving to the position (close position) of the front door 21 shown in FIG. 6B, the guide rail 29 moves further in the mounting direction and the vertically upward direction from the state shown in FIG. 6A. With regard to the mounting direction, since the butting portion 45*a* of the cartridge 7 has butted against the frame 38, the cartridge 7 cannot move in the mounting direction. Therefore, while the pressurizing followers 26 of the guide rail 29 slides on the bottom surface of the cartridge 7, the guide rail 29 moves in the mounting direction.

Between from FIG. 6A to FIG. 6B, the pressing portion 29*a* of the guide rail 29 comes in contact with the portion-to-be-pressed 43*e* of the cartridge 7. At this time, in the connecting portion 293 that includes the boss 29*b* of the guide rail 29 and the hole portion 35*a* of the first pivot link 35*f*, the rib 29*d* of the boss 29*b* and the flat surface portion 35*d* of the hole portion 35*a* come in contact with each other, and the cylinder portion 29*c* of the boss 29*b* and the peripheral surface portion 35*c* of the hole portion 35*a* do not come in contact with each other. Moreover, a reaction force F received by pressurizing followers 26F and 26R serves as a force F added to the first pivot link 35*f* so that a moment acts relative to the rotation center 37*c* of the front door 21 in the direction to close the front door 21. With this, by the rotation moment that occurs on the first pivot link 35*f*, the pressing portion 29*a* of the guide rail 29 presses the portion-to-be-pressed 43*e* of the cartridge 7 in the mounting direction. Then, by pressing the cartridge in this way, a state where the butting portion 45*a* of the cartridge 7 has butted against the inner surface of the frame 38, is held. Furthermore, the position of the cartridge 7 in the direction (vertical direction) of the arrow Q is also held. The state shown in FIG. 6B is a state where the cartridge 7 has been positioned so as to be able to be provided for image forming.

Figure 8B:
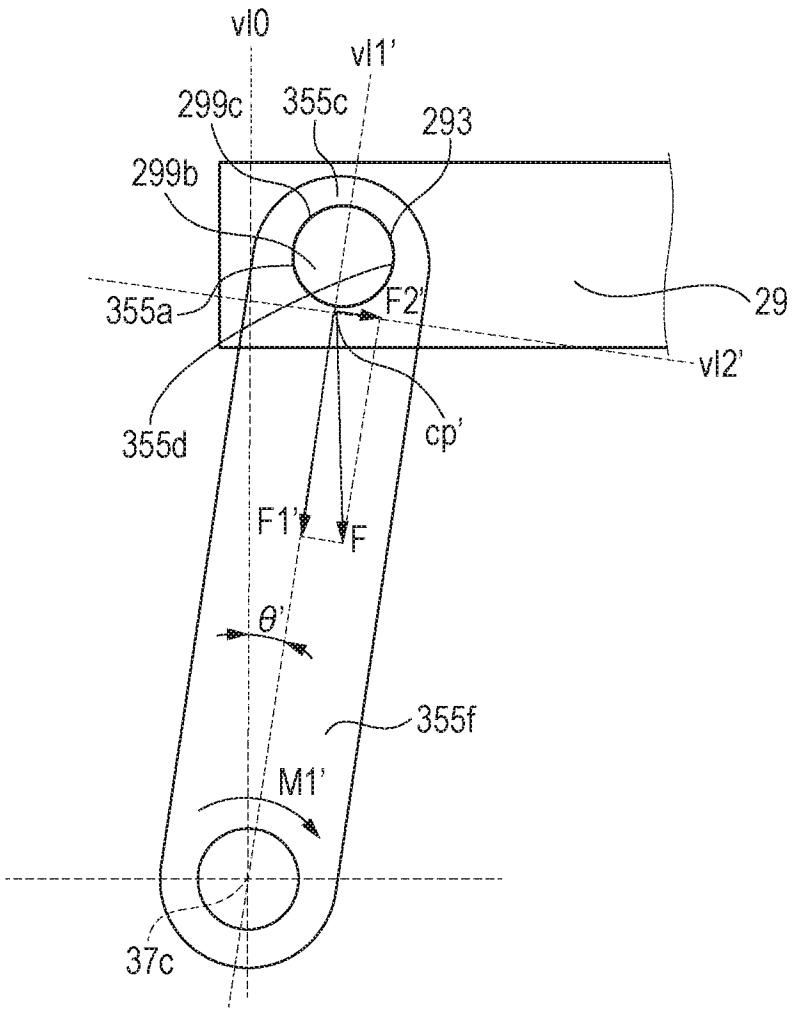
FIG. 8B is an illustration showing the detail of a connecting portion of the first pivot link and the guide rail when the guide rail is at the second position in a comparative example.
Figure 8A:
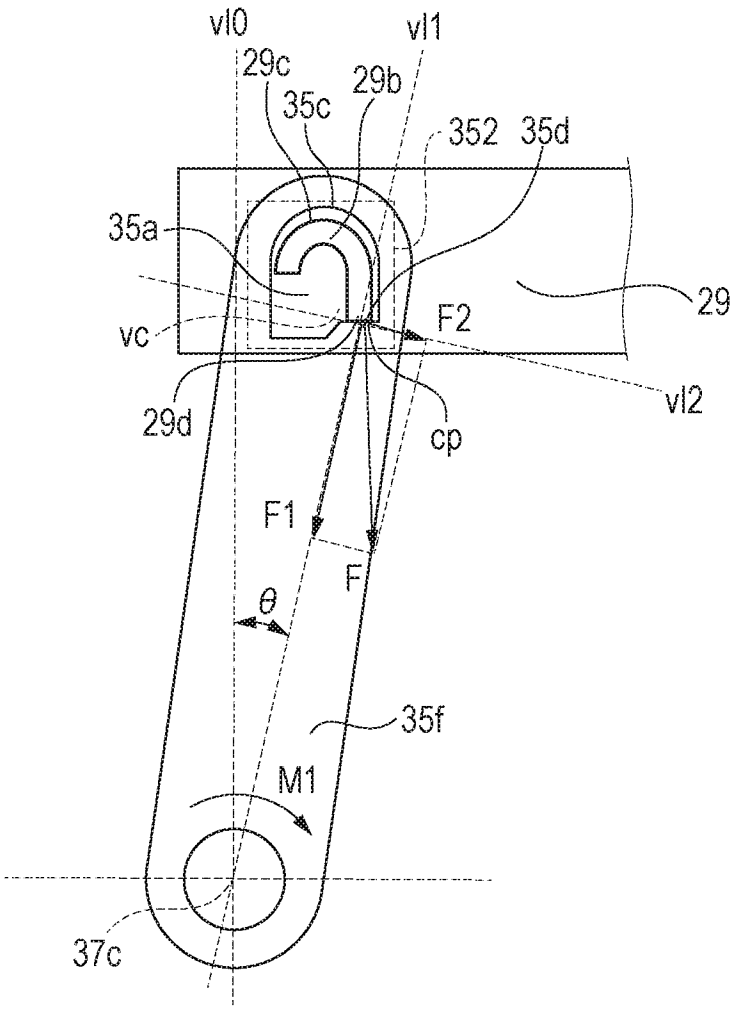
FIG. 8A is an illustration showing the detail of a connecting portion of a first pivot link and the guide rail when the guide rail is at the second position in the present example.

With reference to FIGS. 8A and 8B, description is given to effects in the present example by the characteristic structure of the connecting portion 352 of the hole portion 35*a* of the first pivot link 35*f* and the boss 29*b* of the guide rail 29. In this connection, in the following description, although description is given to the connecting portion 352 of the hole portion 35*a* of the first pivot link 35*f* and the boss 29*b* of the guide rail 29, the connecting portion of the second pivot link 35*r* and the guide rail 29 has also the same structure.

FIG. 8A is an illustration showing the connecting portion 352 of the hole portion 35*a* of the first pivot link 35*f* and the boss 29*b* of the guide rail 29 and its periphery in the present example, when the guide rail 29 is at the second position. FIG. 8B is an illustration showing the connecting portion 293 of a hole portion 355*a* of a pivot link 355*f* and a boss 299*b* of the guide rail 29 and its periphery in a comparative example, when the guide rail 29 is at the second position. The boss 299 in the comparative example includes a cylinder portion 299*c* that has a circumference surface with the same radius as the cylinder portion 29*c* in the present example. In the comparative example, when the guide rail 29 is at the second position, the cylinder surface of a cylinder surface portion 299*c* comes in contact with an inner peripheral surface 355*d* of the hole portion 355*a*.

An image forming apparatus in the comparative example has the same structure as the present example except the connecting portion 293. In the comparative example shown in FIG. 8B, the above-mentioned reaction force F received by the pressurizing followers 26F and 26R is added to the inner peripheral surface 355*d* of the hole portion 355*a* through the cylinder portion 299*c* of the boss 299*b* in the vertically downward direction. This reaction force F is decomposed into a force component F1' in the direction of a first imaginary line vl1' that passes the pivot center 37*c* and a contact point cp' between the cylinder portion 299*c* and the inner peripheral surface 355*d* of the hole portion 355*a* and a force component F2' in the direction of a second imaginary line vl2' vertical to the imaginary line vl1'. A force that makes a rotation moment occur, which makes the pivot link 355*f* rotate around the pivot center 37*c*, is the force component F2'.

On the other hand, in the present example shown in FIG. 8A, the reaction force F (the force with the same direction and magnitude as the comparative example) received by the pressurizing followers 26F and 26R is added to the flat surface portion 35*d* of the hole portion 35*a* through the rib 29*d* of the boss 29*b* in the vertically downward direction. This reaction force F is decomposed into a force component F1 in the direction of a first imaginary line vl1 that passes the pivot center 37*c* and a contact point cp between the rib 29*d* and the flat surface portion 35*d* of the hole portion 35*a* and a force component F2 in the direction of a second imaginary line vl2 vertical to the imaginary line vl1. A force that makes a rotation moment M1 occur, which makes the first pivot link 35*f* rotate around the pivot center 37*c*, is the force component F2.

Here, in the present example, the rib 29*d* protrudes to the outside of an imaginary circle vc that passes the cylinder surface of the cylinder portion 29*c*. Therefore, an angle θ, in the present example in FIG. 8A, formed by an imaginary line vl0 that passes the pivot center 37*c* and extends in the vertical direction and an imaginary line vl1, is larger than an angle θ', in the comparative example in FIG. 8B, formed by the imaginary line vl0 and the imaginary line vl1'. Therefore, the force component F2 in the present example that makes the rotation moment M1 occurs becomes larger than the force component F2' in the comparative example that makes the rotation moment M1' occurs, and the rotation moment M1 is larger than rotation moment M1'.

Therefore, the rotation moment that occurs in the first pivot link 35*f* in the present example is larger than the rotation moment that occurs in the pivot link 355*f* in the comparative example, whereby the guide rail 29 is pressed with a larger force through the first pivot link 35*f* in the mounting direction of the cartridge 7.

Moreover, the radius of rotation of an operating portion 21*a* of the front door 21 is large sufficiently relative to the radius of rotation of the first pivot link 35*f* (a distance from the rotation center of the first pivot link 35*f* to the connecting portion 352). Therefore, with this lever ratio, it becomes possible to give a pressing force to the cartridge 7 by a light operation force. In the present example, it becomes possible to obtain a pressing force for positioning four cartridges in the longitudinal direction simultaneously by an operation of a user for the front door 21.

Moreover, a rotation moment that occurs on the first pivot link 35*f* by the reaction force F received by the pressurizing followers 26F and 26R, acts so as to reduce the urging force of the compression spring 25. The direction of action of such a rotation moment coincides with the direction of a moment made to act on the operating portion 21*a* in an operation that closes the front door 21. With this rotation moment, the guide rail 29 relatively moves in an opposite direction to the direction of Q relative to the cartridge 7. As a result, the compression of the compression spring 35 is eased, and the urging force relative to the cartridge 7 by the compression spring member 35 is reduced. Therefore, the rotation moment that occurs by the pressure of the cartridge 7 is utilized so as to assist the force to close the front door 21, whereby the reduction of an operation force by a user to open and close the front door 21 is attained.

In this connection, with regard to a case of dismounting the cartridge 7 from the apparatus main body 100A, since an operation becomes merely reverse to the operation having been described with reference to FIGS. 5A and 5B, description for it is omitted.

With the configuration described above, since the cartridge 7 is pressed toward the positioning portion in the mounting direction by the guide rail 29, the spring force of the tension spring 32 of the toggle mechanism 312 can be made small. As a result, the force necessary at the time of mounting a cartridge, becomes small, whereby the usability with regard to the mounting can be improved.

In the configuration in which, on an end surface of a cartridge on the downstream side in the mounting direction, there is provided an interface part with the apparatus main body, such as drive couplings and electric contacts, the configuration of the present example is useful. It is possible to assist when a user mounts the cartridge 7 onto the apparatus main body against the reaction force, such as the engaging pressure of the drive coupling of the main body side and the contact pressure of electric contacts.

Moreover, there may be case where, in order not to damage a belt at the time of mounting the drum 1 onto the apparatus main body, the first position for mounting and detaching a cartridge is set at a position sufficiently separated in the vertical direction from the second position for providing the cartridge for image forming. In this case, while the guide rail is moving toward the second position, since a lever rotates in the direction (counterclockwise rotation in the illustration) in which the spring force of a tension spring becomes weaker, the drawing-in force for the cartridge by the lever becomes weaker. By employing the configuration of the present example, it is possible to supplement a decreased amount of the drawing-in force of the lever.

In this connection, in the present example, the configuration provided with the toggle mechanism is employed. However, even in a configuration not provided with the toggle mechanism, an effect that holds a state where the positioning has been made in the mounting direction of the cartridge, is attained.

Moreover, in the present example, although each of the first pivot link and second pivot link has the characteristic configuration in the combining part to combine with the guide rail. However, only the first pivot link may include such a configuration.

EXAMPLE 2

An Example 2 according to the present disclosure will be described. With regard to the configurations and functions common to the Example 1, the same symbols are given, and description is omitted. Accordingly, only characteristic portions are described.

Figure 9A:
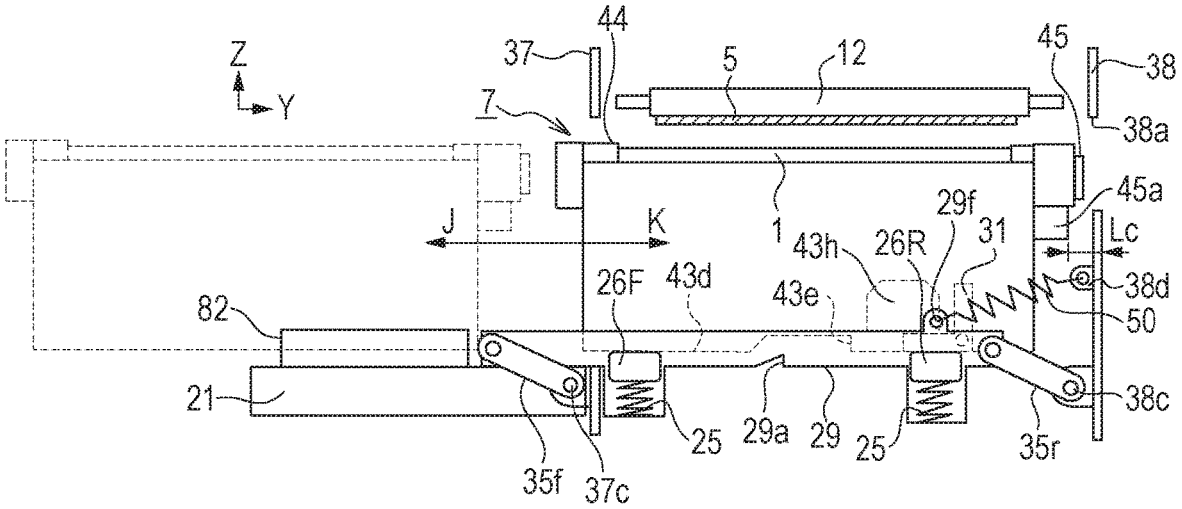
FIG. 9A is an illustration showing a position of each of the cartridge and the guide rail when the guide rail according to the Example 2 is at the first position.
Figure 9B:
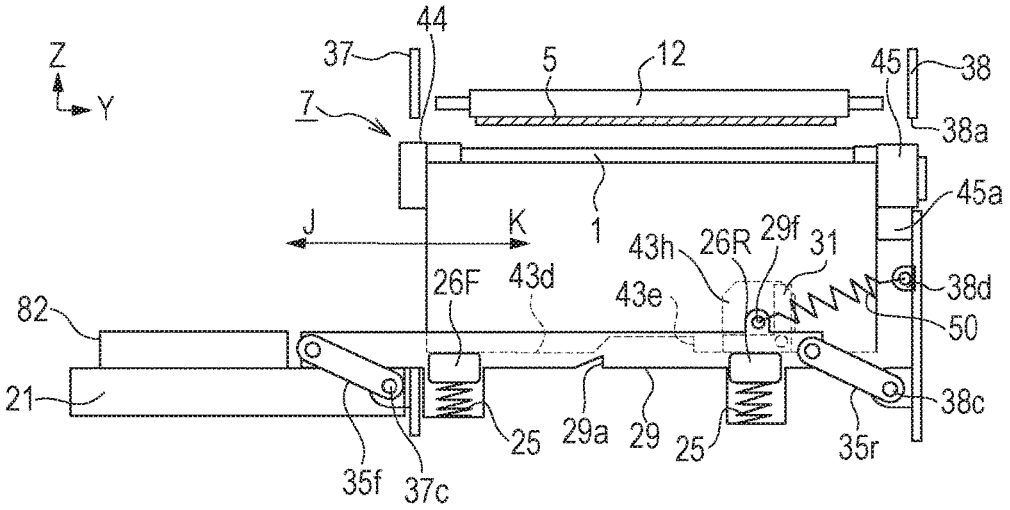
FIG. 9B is an illustration showing a position of each of the cartridge and the guide rail when the guide rail according to the Example 2 is at the third position.

FIGS. 9A and 9B are a schematic configuration illustration of a cartridge and an apparatus main body at the time of mounting a cartridge of an image forming apparatus in the Example 2.

A point different from the Example 1 is a point that a drawing-in spring 50 shown in FIGS. 9A to 10B is provided to an apparatus main body 100A. One end is hung on the hooking portion 38*d* of the frame 38, and the other end is hung on the hooking portion 29*f* of the guide rail 29.

When the guide rail 29 is at a position (the first position) for mounting and detaching the cartridge 7 shown in FIG. 9A, it becomes as follows. By the tensile three of the drawing-in spring 50, a force that the first pivot link 35*f* rotates clockwise in the illustration (the direction in where the front door 21 closes), acts on the first pivot link 35*f* through the guide rail 29. However, since the first pivot link 35*f* is connected to the front door 21, the first pivot link 35*f* does not move due to the self-weight of the front door 21.

From this state, when the cartridge 7 is moved in the mounting direction relative to the apparatus main body 100A, similarly to the Example 1, the position of the cartridge 7 in the mounting direction transits to a third position in which the position of the cartridge 7 is determined (FIG. 9B).

Figure 10A:
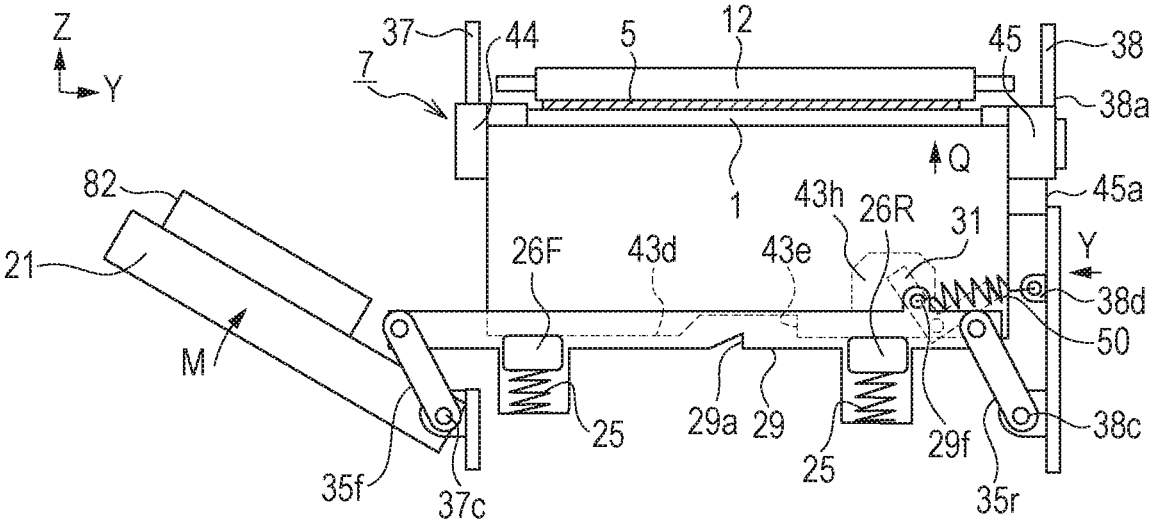
FIG. 10A is an illustration showing a position of each of the cartridge and the guide rail when the guide rail according to the Example 2 is between the third position and the second position.

Next, as shown in FIG. 10A, when a closing operation or the front door 21 so as to make the front door 21 pivot in the direction of the arrow M is started, the self-weight of the cartridge 7 is added to the guide rail 29 through the pressurizing followers 26F and 26R. However, since the guide rail 29 moves in the mounting direction by the tensile force of the drawing-in spring 50, it becomes possible for a user to close the front door 21 with a small operation force.

Figure 10B:
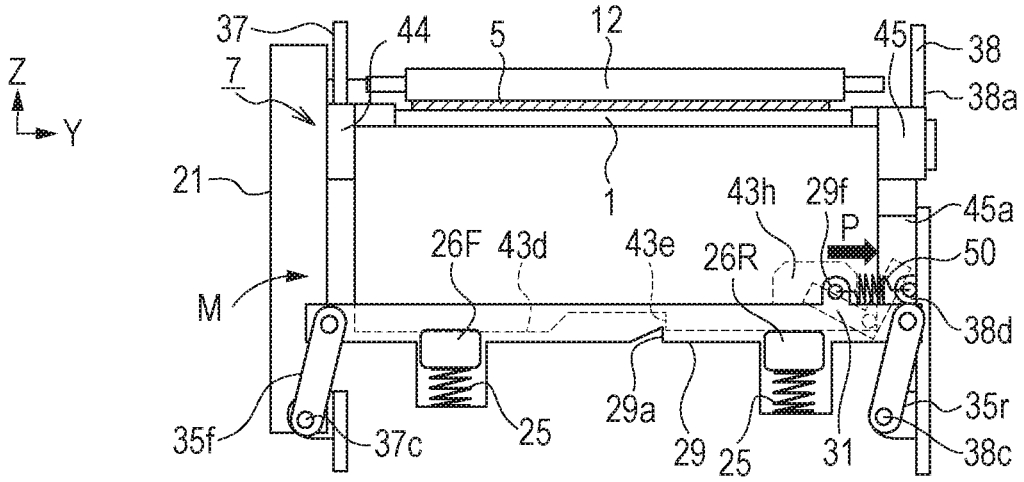
FIG. 10B is an illustration showing a position of each of the cartridge and the guide rail when the guide rail according to the Example 2 is at the second position.

Furthermore, as shown in FIG. 10B, in the operation until the closing of the front door is finished, when the guide rail 29 becomes close to the uppermost position in the vertical direction, its movement becomes parallel movement. Accordingly, a resistance force received by the pressurizing followers 26F and 26R from the cartridge 7 becomes small. That is, by a force P that occurs by a drawing-in spring, the pressing portion 29*a* of the guide rail 29 presses the portion-to-be-pressed 43*e* of the cartridge 7, and the cartridge 7 is held at a position (the first position) where the butting portion 45*a* of the cartridge 7 has butted against the inner surface of the frame 38. The position shown in FIG. 10B is the second position where it is possible to provide the cartridge for image forming. With the above-mentioned configuration, even in the Example 2, it is possible to acquire the effects similar to those in the Example 1, and it is possible to expect the above effects with a comparatively simple configuration.

In this connection, in the Examples 1 and 2, the cartridge includes the photosensitive drum, the charging unit, the development roller, and the cleaning unit, and is detachable relative to the apparatus main body. However, the configuration of the cartridge is not limited to this. For example, it may be permissible to use a cartridge including the photosensitive drum and at least one of the charging unit, the development roller, and the cleaning unit. Furthermore, it may be permissible to use a cartridge that includes the development roller and the storage portion to store toner to be supplied to the development roller and does not include the photosensitive drum. Moreover, it may be permissible to use a cartridge that includes the storage portion to store toner and the stirring member that stirs the stored toner while rotating. That is, if a cartridge includes a rotating body and is detachable to the apparatus main body, the present disclosure can be applied to the cartridge.

Moreover, in the Examples 1 and 2, a color image forming apparatus and cartridge of the contact developing method have been used. However, the present disclosure can be applied also to a monochrome image forming apparatus, a noncontact developing system, or a developing unit mountable to an apparatus main body and a developer unit having developer.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-224157, filed Nov. 29, 2018, which is hereby incorporated by reference herein in its entirety.

What is claimed is:

1. An image forming apparatus comprising:

a cartridge that includes a rotating body configured to rotate and to bear toner, wherein the cartridge includes a portion-to-be-pressed and a portion-to-be-positioned; and an apparatus main body to which the cartridge is mounted in a mounting direction, wherein the apparatus main body includes a linkage mechanism and includes a positioning portion configured to position the cartridge with respect to the apparatus main body in the mounting direction by coming in contact with the portion-to-be-positioned of the cartridge, wherein the link mechanism includes a frame, a first link having a first end portion and a second end portion opposite to the first end portion in a longitudinal direction of the first link, wherein the first end portion is connected to the frame so as to pivot around a pivot axis, and the second end portion of the first link is provided with a hole portion, and a second link including a mounting portion on which the cartridge is mounted and a pressing portion configured to press the cartridge in the mounting direction by coming in contact with the portion-to-be-pressed of the cartridge, wherein the second link is provided with a protrusion extending in a direction of the pivot axis and engaging with the hole portion of the first link, and wherein the second link is pivotable, relative to the first link, at a joint portion at which the second link protrusion engages with the hole portion of the first link, wherein the second link protrusion includes a cylinder portion and a protruding portion that protrudes to an outside of an imaginary circle of a cylindrical surface of the cylinder portion when viewed in the pivot axis direction, wherein the linkage mechanism is configured such that, with interlocking with a pivotal movement of the first link around the pivot axis in a predetermined pivot direction, the second link is moved from a first position to a second position, wherein the first position is a position in which the cartridge is to be mounted to, and detached from, the mounting portion of the second link, and wherein the second position is a position for image forming, and wherein, when the second link is at the second position, the protruding portion of the second link protrusion presses an inner surface of the hole portion of the first link such that a rotational moment around the pivot axis in the predetermined pivot direction acts on the first link and, in a state where the portion-to-be-pressed of the cartridge is pressed by the pressing portion of the second link, the portion-to-be positioned of the cartridge comes in contact with the positioning portion of the apparatus main body.

2. The image forming apparatus according to claim 1, wherein the positioning portion is a first positioning portion, and the portion-to-be-positioned is a first portion-to-be-positioned, wherein the apparatus main body has a second positioning portion to position the cartridge, with respect to the apparatus main body, in a vertical direction, and the cartridge has a second portion-to-be-positioned to come in contact with the second positioning portion, wherein the mounting portion includes a supporting member and an urging member to urge the supporting member vertically upward, and wherein, when the cartridge is in the second position, the cartridge is urged by the supporting member such that the second portion-to-be-positioned of the cartridge comes in contact with the second positioning portion of the apparatus main body and, by a reaction force received by the supporting member from the cartridge, the protruding portion of the second link protrusion presses the inner surface of the hole portion of the first link in a vertically downward direction.

3. The image forming apparatus according to claim 1, wherein the apparatus main body includes an opening portion through which the cartridge passes when the cartridge is mounted to the apparatus main body, and an opening and closing member configured to be movable between a closing position in which the opening portion is closed and an opening position in which the opening portion is opened, and wherein the second link is moved from the first position to the second position with interlocking with movement of the opening and closing member from the opening position to the closing position.

4. The image forming apparatus according to claim 1, wherein the second link includes a drawing-in mechanism to draw the cartridge in the mounting direction.

5. The image forming apparatus according to claim 1, wherein the mounting direction is a direction of a rotational axis of the rotating body.

6. The image forming apparats according to claim 1, further comprising a third link having a third end portion and a fourth end portion opposite to the third end portion in a longitudinal direction of the third link, wherein the third end portion is connected to the frame so as to pivot around a second pivot axis extending in the pivot axis direction, and the fourth end portion of the third link is connected to a second portion of the second link different from a first portion of the second link at which the second link protrusion is provided in a longitudinal direction of the second link so as to pivot with respect to the second link.

7. A linkage mechanism comprising:

a frame;

a first link having a first end portion and a second end portion opposite to the first end portion in a longitudinal direction of the first link, wherein the first end portion is connected to the frame so as to pivot around a pivot axis, and the second end portion of the first link is provided with a hole portion; and a second link provided with a protrusion protruding in a direction of the pivot axis and engaging with the hole portion of the first link so as to pivot, relative to the first link, at a joint portion at which the second link protrusion engages with the hole portion of the first link, wherein the second link protrusion includes a cylinder portion and a protruding portion that protrudes to an outside of an imaginary circle of a cylindrical surface of the cylinder portion when viewed in a direction of the pivot axis, and wherein when the second link is moved from a first position to a second position different from the first position with interlocking with a pivotal movement of the first link around the pivot axis, the protruding portion of the second link protrusion presses an inner surface of the hole portion of the first link such that a rotational moment around the pivot axis acts on the first link.

8. The linkage mechanism according to claim 7, further comprising a third link having a third end portion and a fourth end portion opposite to the third end portion in a longitudinal direction of the third link, wherein the third end portion is connected to the frame so as to pivot around a second pivot axis extending in the pivot axis direction, and the fourth end portion of the third link is connected to a second portion of the second link different from a first portion of the second link at which the second link protrusion is provided in a longitudinal direction of the second link so as to pivot with respect to the second link.

* * * * *